US010161344B2

(12) United States Patent
Dudar

(10) Patent No.: US 10,161,344 B2
(45) Date of Patent: Dec. 25, 2018

(54) LEAKY INJECTOR MITIGATION ACTION FOR VEHICLES DURING IDLE STOP

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 783 days.

(21) Appl. No.: 14/845,018

(22) Filed: Sep. 3, 2015

(65) Prior Publication Data

US 2017/0067407 A1 Mar. 9, 2017

(51) Int. Cl.

| | |
|---|---|
| ***F02D 41/30*** | (2006.01) |
| ***F02D 17/04*** | (2006.01) |
| ***F02D 35/00*** | (2006.01) |
| ***F02D 35/02*** | (2006.01) |
| ***F02D 41/08*** | (2006.01) |
| ***F02D 41/22*** | (2006.01) |
| ***F02D 41/02*** | (2006.01) |
| *F02D 41/04* | (2006.01) |
| *F02N 11/08* | (2006.01) |
| *F02N 19/00* | (2010.01) |

(52) U.S. Cl.

CPC ..... *F02D 41/3005* (2013.01); *F02D 17/04* (2013.01); *F02D 35/0007* (2013.01); *F02D 35/02* (2013.01); *F02D 41/0295* (2013.01); *F02D 41/08* (2013.01); *F02D 41/221* (2013.01); *F02D 41/042* (2013.01); *F02D 2041/225* (2013.01); *F02D 2200/0814* (2013.01); *F02N 11/0814* (2013.01); *F02N 2019/008* (2013.01); *F02N 2200/023* (2013.01)

(58) Field of Classification Search

CPC .. F02D 41/3005; F02D 41/0295; F02D 41/08; F02D 17/04; F02D 35/0007; F02D 35/02; F02D 41/221; F02D 2200/0814; F02D 2041/225; F02D 41/042; F02N 2019/008; F02N 2200/023; F02N 11/0814

See application file for complete search history.

(56) References Cited

U.S. PATENT DOCUMENTS

| | | | | |
|---|---|---|---|---|
| 5,492,098 | A | 2/1996 | Hafner et al. | |
| 6,073,436 | A | 6/2000 | Bell et al. | |
| 6,119,959 | A | 9/2000 | Smith, III et al. | |
| 6,719,224 | B2 | 4/2004 | Enomoto et al. | |
| 2016/0245196 | A1 * | 8/2016 | Kojima | F02D 37/02 |
| 2017/0198671 | A1 * | 7/2017 | Dudar | F02M 25/089 |

* cited by examiner

*Primary Examiner* — Stephen K Cronin
*Assistant Examiner* — Xiao Mo
(74) *Attorney, Agent, or Firm* — Julia Voutyras; McCoy Russell LLP

(57) ABSTRACT

Methods and systems are provided for mitigating the effects of a leaky fuel injector during vehicle idle stop conditions. In one example, a method may include identifying the cylinder with a leaky fuel injector, and at or during engine shutdown, positioning the engine to a selected position based on the identified cylinder such that an exhaust valve of the identified cylinder is at least partly open.

20 Claims, 6 Drawing Sheets

LEAKY INJECTOR MITIGATION ACTION FOR VEHICLES DURING IDLE STOP

FIELD

The present description relates generally to methods and systems for controlling a vehicle engine with a fuel injector leak during idle stops.

BACKGROUND/SUMMARY

Engine fuel injectors may become degraded and start to leak fuel into a corresponding engine cylinder. Such leaky fuel injectors may degrade fuel consumption, increase emissions, and cause engine start issues. Attempts to address the problem of fuel injector leaks may include corrective actions that are implemented while the engine is running In one example approach, a lean air-fuel mixture is delivered to a cylinder with the leaking fuel injector to compensate for the presence of leaked fuel and/or other cylinders may be operated with a lean air-fuel ratio.

However, the inventors herein have recognized an issue with the above approach in that the above mentioned corrective actions may be implemented only when the engine is running and not during engine off conditions. In particular, relying on engine operating corrective actions may be problematic in vehicles configured to perform automatic stops. For example, a vehicle travelling in congested traffic may encounter frequent start and stop events. During such idle stops, a leaky fuel injector may cause problems during subsequent engine restart, including engine misfire, stumble, hydro lock, etc., and degrade vehicle emissions. Fuel leak during prolonged idle stops may also allow fuel to seep past the piston rings and into the crankcase, wherein it may dilute the engine oil and diminish engine lubrication, increasing the possibility of engine damage.

To at least partially address fuel injector leaks in vehicles, such as those with prolonged idle stops, a method for operating an engine is provided, comprising identifying a cylinder of an engine with a fuel injector leak, and at or after engine shutdown, positioning the engine to a selected engine position based on the identified cylinder such that an exhaust valve of the identified cylinder is at least partly open. By positioning the identified cylinder with the exhaust valve open during idle stops, the leaked fuel from the injector may vaporize from the hot cylinder wall and escape by natural diffusion through the open exhaust valve to a downstream catalyst, where the leaked fuel vapors may be converted prior to releasing to atmosphere. As one example, a starter motor may be used to re-position the engine based on the identified cylinder with leaky fuel injector, such that the exhaust valve of the identified cylinder is at least partly open during engine idle stops.

The present description can provide several advantages. Specifically, the method can reduce engine emissions, engine misfire, engine roughness, and engine damage in vehicles used for frequent city driving with prolonged idle stops.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
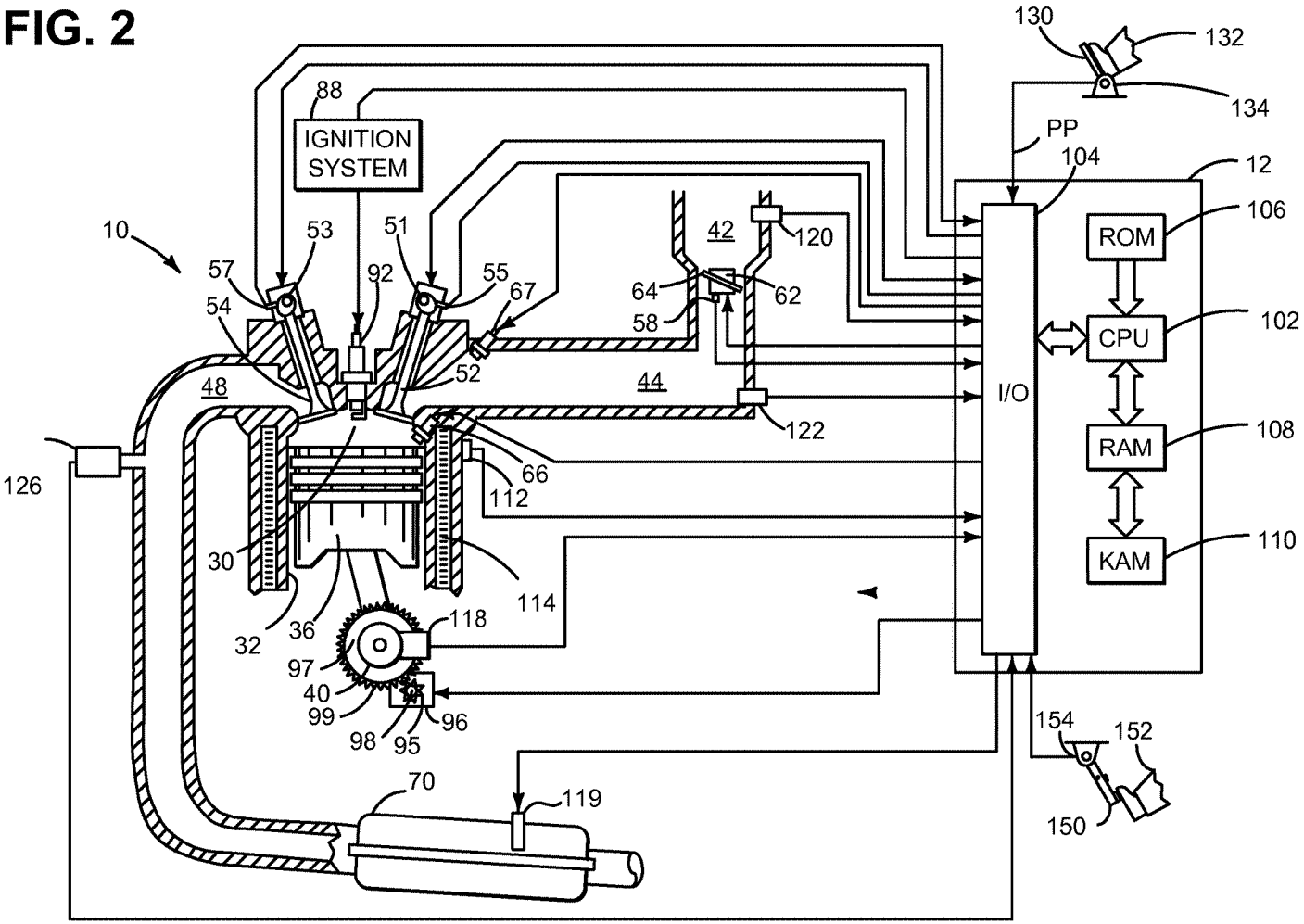
FIG. 2 illustrates a schematic depiction of an internal combustion engine.
Figure 3:
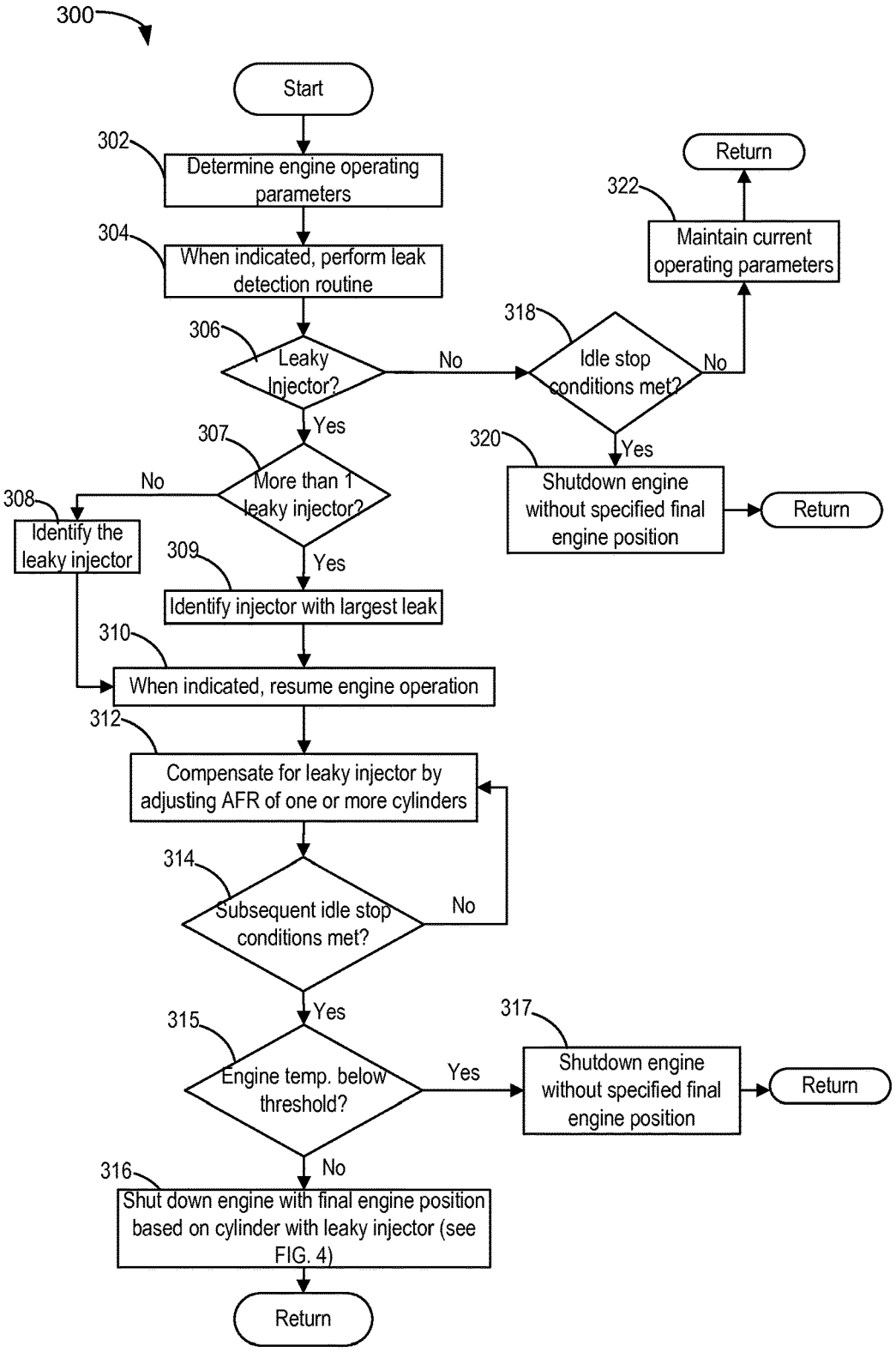
FIG. 3 presents a flowchart illustrating an example routine for detecting an engine cylinder with a leaky fuel injector and re-positioning the engine during an idle stop event.
Figure 4:
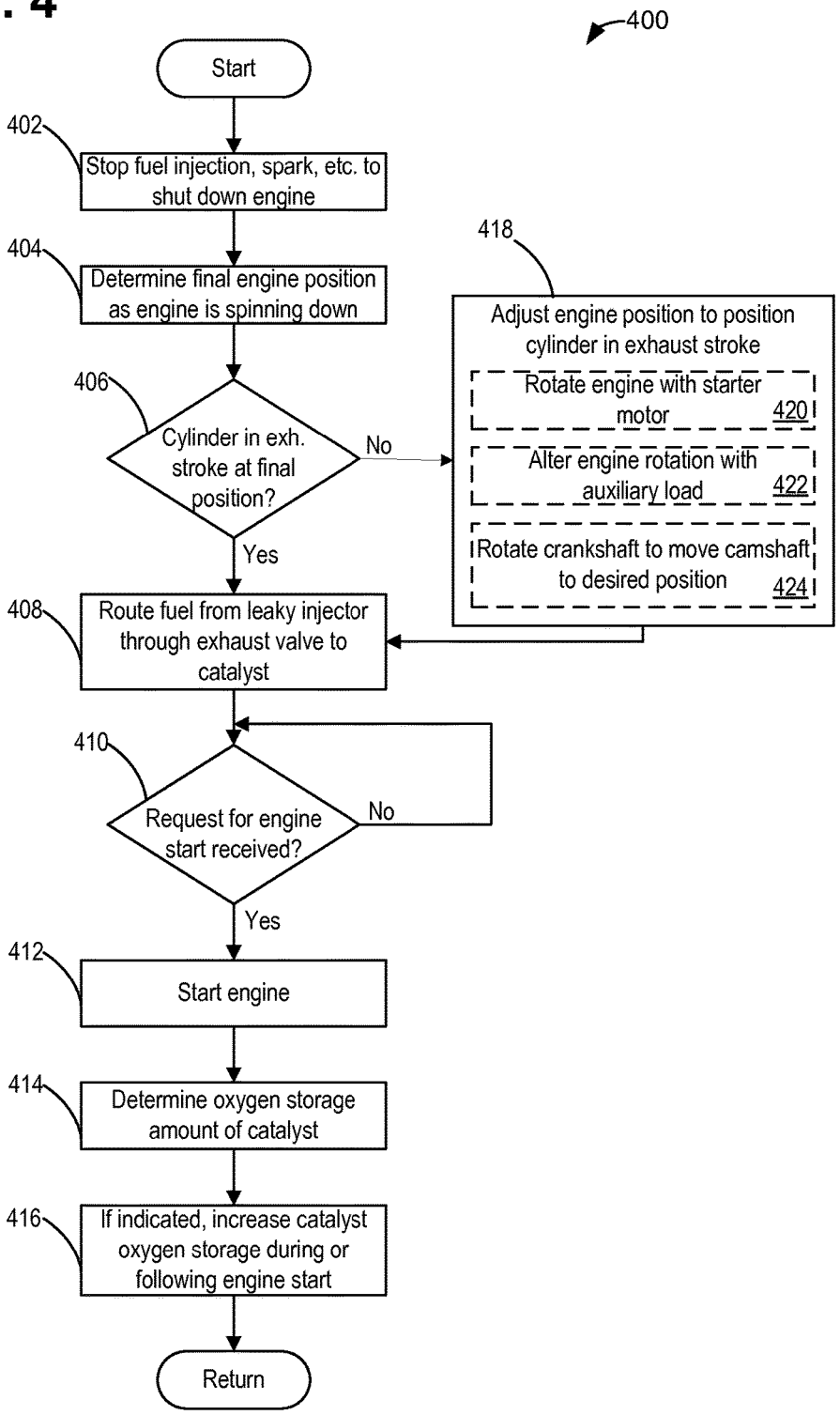
FIG. 4 presents a flowchart illustrating a routine for re-positioning the engine to a position based on the cylinder identified in the method of FIG. 3.
Figure 5:
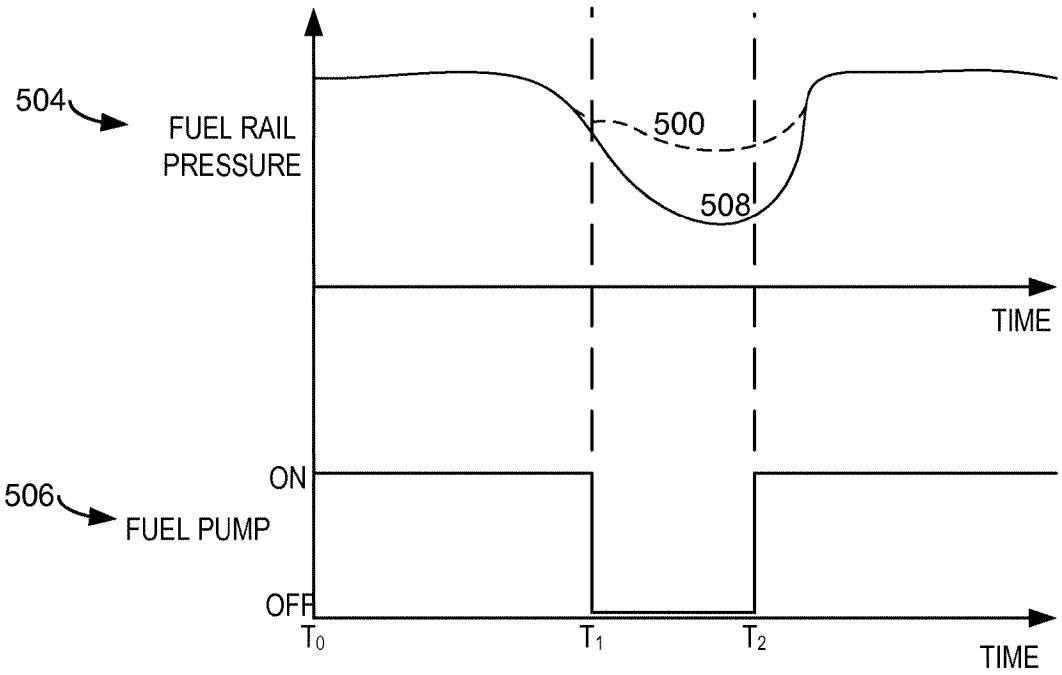
FIG. 5 shows example plots of fuel rail pressure and fuel pump operation during an idle stop.
Figure 6:
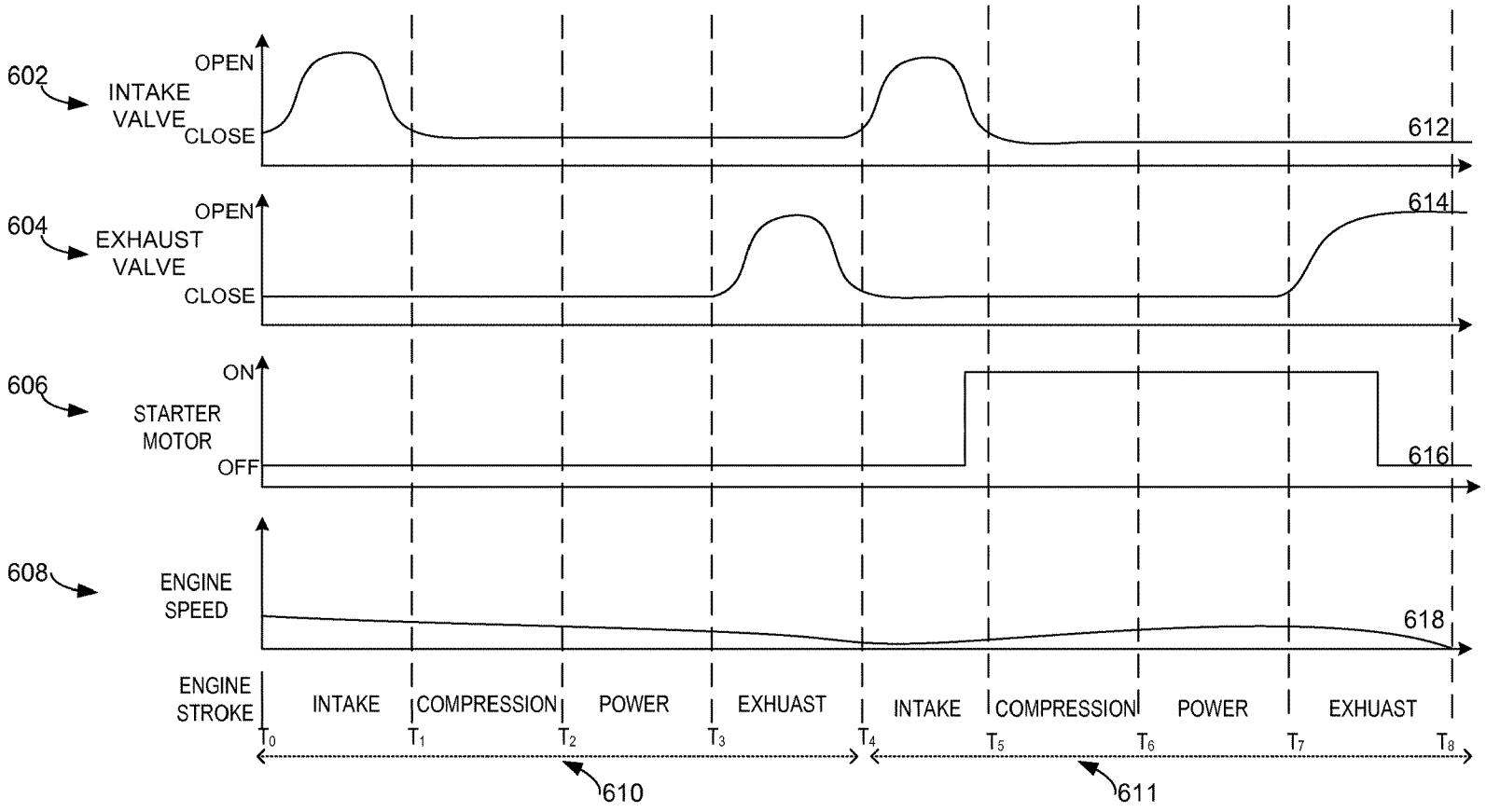
FIG. 6 illustrates example plots of interest during an engine shutdown with a leaky fuel injector.

The following description relates to systems and methods for controlling a vehicle engine with a fuel injector leak during idle stops. In one example, a vehicle system includes an engine which may be supplied with fuel by a fuel supply system as configured in FIG. 1. A detailed schematic of one cylinder of an engine is illustrated in FIG. 2. FIGS. 3 and 4 illustrate methods to identify an engine cylinder with leaky fuel injector and re-position the engine during idle stops to mitigate the effects of fuel leak. FIG. 5 shows example plots of fuel pump operation and fuel rail pressure during an engine stop and FIG. 6 illustrates example plots of intake and exhaust valve positions after re-positioning of an engine cylinder during a four stroke engine cycle using a starter motor.

Figure 1:
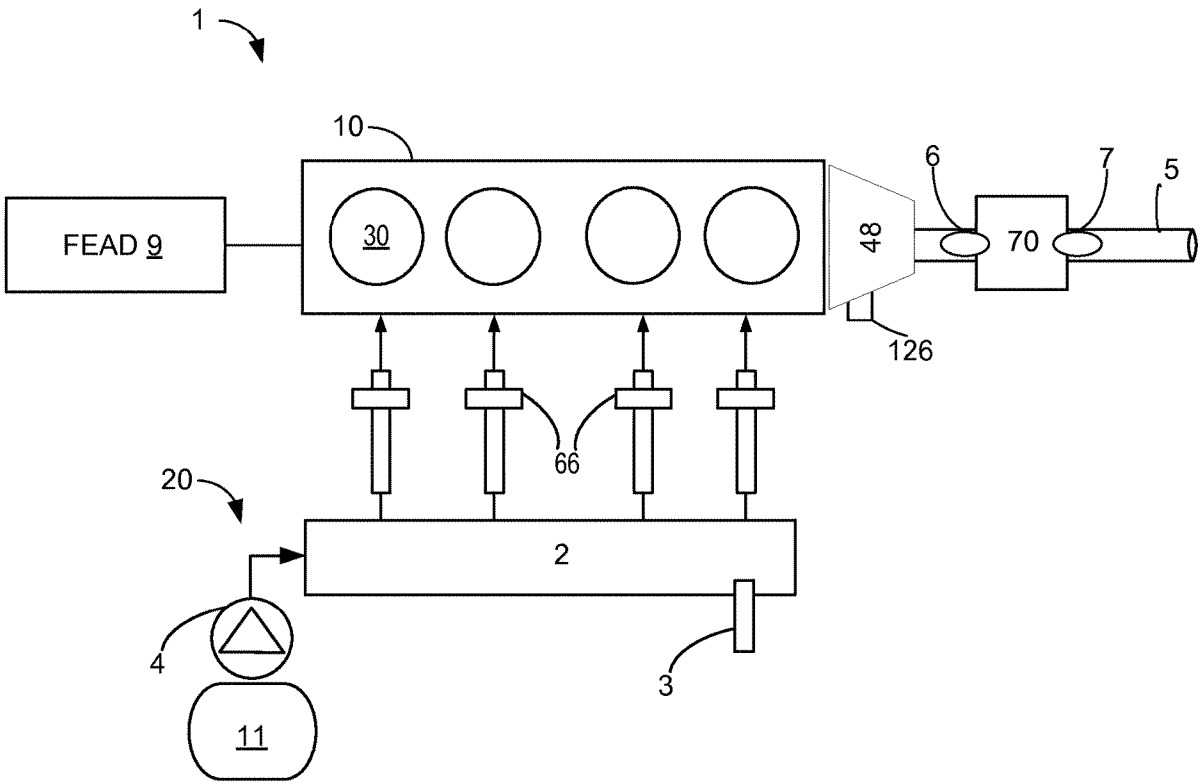
FIG. 1 shows a schematic depiction of a fuel system coupled to an engine system.

A vehicle system 1 including a fuel system 20 is illustrated in FIG. 1. The fuel system 20 delivers fuel to an engine 10 with a plurality of cylinders 30. The fuel system 20 includes a fuel storage tank 11 for storing the fuel on-board the vehicle, and a fuel pump 4 for pumping high pressure fuel to a high pressure fuel rail 2. The high pressure fuel rail 2 also includes a fuel rail pressure sensor 3 for monitoring the fuel rail pressure.

The fuel rail 2 delivers high pressure fuel to the cylinders 30 through a plurality of direct fuel injectors 66. The embodiment of the fuel system 20 is depicted as a system including solely direct injectors 66. However, this is one example of the fuel system, and other embodiments may include additional components (or may include fewer components) without departing from the scope of this disclosure. For example, the fuel system 20 may additionally or alternatively include port fuel injectors.

The high-pressure fuel pump 4 pressurizes fuel for delivery through the fuel rail 2. Fuel travels through the fuel rail 2 to at least one fuel injector 66, and ultimately to at least one engine cylinder 30 where fuel is combusted to provide power to the vehicle. In order to reduce the likelihood of engine degradation, the common rail fuel system may be monitored for fuel leaks. In one example the fuel rail pressure is monitored by the fuel rail pressure sensor 3. The health of individual direct fuel injectors 66 may also be monitored, for example by monitoring fuel rail pressure before and after an injection event, for each fuel injector of the engine, and identifying a degraded fuel injector if the change in rail pressure after the injection event for that injector is greater than expected.

The engine 10 is connected to an engine exhaust passage 5 though an exhaust manifold 48 that routes exhaust gasses to the atmosphere. The exhaust passage 5 includes one or more emission control devices 70 mounted in a close coupled position. The emission control devices 70 may include a three-way catalyst (TWC), lean NOx trap, oxidation catalyst, etc. Oxygen sensors 6 and 7 are present at the inlet and outlet of the emission control device 70. A Universal Exhaust Gas Oxygen (UEGO) sensor 126 is shown coupled to the exhaust manifold 48, upstream of the emission control device 70. Alternatively, a two-state exhaust gas oxygen sensor may be substituted for the UEGO sensor 126. Likewise, the oxygen sensors 6 and 7 may each be a wideband sensor, narrowband sensor, heated sensor, or other suitable sensor.

The vehicle system 1 further includes a front end accessory drive (FEAD) 9 coupling the engine 10 to one or more loads. Example loads include, but are not limited to, an alternator, air conditioning compressor, water pump, and other suitable loads.

Referring to FIG. 2, a single cylinder of engine 10 of FIG. 1 is shown. Internal combustion engine 10, comprising a plurality of cylinders, one cylinder of which is shown in FIG. 2, is controlled by electronic engine controller 12. Engine 10 includes combustion chamber 30 and cylinder walls 32 with piston 36 positioned therein and connected to crankshaft 40. Combustion cylinder, 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by the fuel system 20 shown in FIG. 1. Fuel injector 66 is supplied operating current from driver 68 which responds to controller 12. In addition, intake manifold 44 is shown communicating with optional electronic air inlet throttle 62 which adjusts a position of air inlet throttle plate 64 to control air flow from air intake 42 to intake manifold 44. In one example, a high pressure, dual stage, fuel system may be used to generate higher fuel pressures. Ignition coil 88 provides an ignition spark to combustion chamber 30 via spark plug 92 in response to a signal from controller 12.

Engine starter 96 may selectively engage flywheel 98 which is coupled to crankshaft 40 to rotate crankshaft 40. Engine starter 96 may be engaged via a signal from controller 12. In some examples, engine starter 96 may be engaged without input from a driver dedicated engine stop/start command input (e.g., a key switch or pushbutton). Rather, engine starter 96 may be engaged via pinion 91 when a driver releases a brake pedal or depresses accelerator pedal 130 (e.g., an input device that does not have a sole purpose of stopping and/or starting the engine). In this way, engine 10 may be automatically started via engine starter 96 to conserve fuel.

Controller 12 is shown in FIG. 2 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; barometric pressure from sensor 124; and a measurement of air inlet throttle position from sensor 58. In a preferred aspect of the present description, engine position sensor 118 produces a predetermined number of equally spaced pulses every revolution of the crankshaft from which engine speed (RPM) can be determined. Controller 12 also adjusts current to field coil 97 to control torque applied by starter 96 to crankshaft 40.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

The controller 12 receives signals from the various sensors of FIGS. 1 and 2 and employs the various actuators of FIGS. 1 and 2 to adjust engine operation based on the received signals and instructions stored on a memory of the controller. For example, adjusting engine position (e.g., re-positioning the engine or components of a cylinder) may include activating the starter motor 96 of FIG. 2 and engaging the flywheel 98 in order to adjust engine position. In another example, adjusting engine position may be achieved by further adjusting a load placed on the engine by engaging one or more loads associated with the FEAD 9, adjusting a field current of an alternator, other suitable mechanism for adjusting engine load.

In one example, adjusting engine position may include rotating a crankshaft of the engine mechanically coupled via a cam timing chain/belt to the exhaust camshaft to adjust rotation of the camshaft and thus position of exhaust valves driven by the camshaft. While such adjusting of the camshafts to adjust position of exhaust valves may also adjust position of pistons within the cylinder, the desired stopping position of the adjustment may be selected so that at least one exhaust valve in the selected cylinder with the leaky fuel injector is at least partially held open by a cam surface of the exhaust camshaft pressing the valve stem of the exhaust valve against its return spring to hold it in the open position once the engine rotation is stopped. In this way, as the engine remains stopped and not rotating at zero engine speed, fuel leaked into the cylinder is evaporated and/or vaporized by residual exhaust heat from the cylinder walls and/or piston surface and can escape through natural gas motion out the at least partially open exhaust valve to the downstream catalyst for conversion.

It should be noted that in some examples, the system may determine the most leaky injector if multiple injectors are determined by the controller to be leaking In this case, the cylinder with the most leaky injector is selected as the desired cylinder to have its exhaust valve open during and throughout a stopped engine condition after engine operation and remain in that position from the stop to an instance where engine temperature falls below a threshold temperature, for example at temperature below which fuel no longer vaporizes. In another example, if the engine shutdown occurs during engine operation where the engine has not yet warmed above this threshold temperature, then the engine may be stopped without further adjustment to move the selected cylinder to have its exhaust valve open. For example the selected cylinder may be held in a condition where its exhaust valve is fully closed in this low temperature conditions.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As explained above, fuel injectors, such as fuel injector 66 described above, may become degraded and leak fuel into a corresponding cylinder (e.g., cylinder 30). During engine operation, the leaky fuel injector may be compensated by reducing the amount of fuel the injector is commanded to deliver and/or reducing the fuel injection amounts of one or more other cylinders of the engine, in order to maintain operator-requested torque and overall stoichiometric air-fuel ratio. However, such compensations do not address fuel leakage that may occur following an engine shutdown. If fuel is leaked into a cylinder while the engine is shutdown, various issues may occur during a subsequent engine start, such as engine misfire, engine stumble, and hydro lock. These problem may be exacerbated in idle stop-start vehicles, as such vehicles experience a large amount of engine shutdowns and subsequent restarts. Further, in some examples, a fuel rail configured to provide high-pressure fuel to the leaky fuel injector may remain at a higher pressure during an idle stop than during a normal, operator-requested shutdown, in order to provide for expedited idle restarts, for example. As such, fuel may be more likely to leak out of an injector during an idle stop.

According to embodiments disclosed herein, an engine having a fuel injector leak may be detected and the cylinder with the leaky fuel injector identified. Once the cylinder with the leaky fuel injector is identified, the engine may be positioned to a selected position at or during engine shutdown such that an exhaust valve for the identified cylinder is at least partly open (e.g., during the exhaust stroke of the identified cylinder). To position the engine at the selected position, an electric motor, such as starter motor 96 of FIG. 2, may be activated in order to rotate the engine to the selected position. In doing so, fuel that leaks out of the leaky fuel injector after engine shutdown may travel out of the cylinder via the open exhaust valve and to a downstream catalyst, where the fuel vapors may be converted, thus improving vehicle emissions and preventing engine restart problems and engine damage.

Referring now to FIG. 3, a flowchart of an example method 300 for identifying and positioning an engine with a leaky fuel injector during vehicle idle stop is shown. Instructions for carrying out method 300 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At 302, the method 300 determines engine operating parameters which may include engine load, engine temperature, engine speed, etc. Once engine operating conditions are determined, and conditions for executing fuel injector diagnostics are met, the routine proceeds to 304, wherein fuel injector diagnostics routine may be performed. As examples, at 302, if engine parameters show high engine load, the fuel injector diagnostics may not be initiated. In another example, fuel injector leak diagnostics may be executed after a predetermined number of miles is driven. In one example of fuel leak diagnostics, the fuel pump operation may be suspended while the engine is idle, and fuel rail pressure may be monitored by a fuel rail pressure sensor, such as the fuel rail pressure sensor 3 of FIG. 1, before and after an injection event, and the pressure difference can be used to correlate to leak in the fuel injection system. After the leak detection diagnostics are performed, the method 300 proceeds to 306 to determine in the engine a leaky fuel injector. If no injector leak is detected at 306, the engine operation continues and proceeds to 318, where idle stop conditions are assessed. As examples, sensors responsive to engine speed, brake pedal position, and accelerator pedal position may be used to determine idle stop conditions. For example, an idle stop condition may occur when vehicle brake pedal is depressed by the vehicle operator, when the engine speed is below a threshold, and/or when operator-requested torque is below a threshold. If the conditions for idle stop are not met, the method 300 proceeds to 322, where the engine operating parameters are maintained and then method 300 returns. If idle stop conditions are met at 318, the method 300 proceeds to 320 to shut the engine down without re-positioning of the cylinders. In one example, shutting the engine down without re-positioning of the cylinders includes stopping fuel injection, deactivating spark ignition, and allowing the engine to spin down to an undefined stop position. Method 300 then returns.

At 306, if leaky injector is detected, the routine 300 proceeds to 307 to identify if one or more than one cylinder has a leaky fuel injector. In one example, a pressure based diagnostics routine can be performed, wherein the fuel rail pressure is measured by a fuel rail pressure sensor before and after an injection event injecting fuel through one of a plurality of fuel injectors, and based on the pressure difference, the degraded fuel injector is identified. However, other mechanisms for determining which fuel injector is leaking are also within the scope of this disclosure. If more than one leaky injector is detected at 307, the method 300 proceeds to 309 to identify the cylinder with the largest leak. The method then proceeds to 310. If one leaky injector is detected at 307, method 300 proceeds to 308 to identify the leaky injector, after which it proceeds to 310.

After the leaky injector is identified, the method 300 proceeds to 310 to resume normal (e.g., non-diagnostic) engine operations when indicated. The method 300 then proceeds to 312 to adjust air-fuel ratio (AFR) in one or more cylinders to mitigate the fuel injector leak. In one example, the amount of fuel supplied to the one or more remaining cylinders (e.g., cylinders without a leaky fuel injector) during a subsequent engine cycle may be altered to compensate for corresponding amount of fuel leaked into the identified cylinder. Additionally or alternatively, the amount of fuel supplied to the cylinder(s) with the leaky injector may be altered (e.g., reduced) to compensate for the amount of fuel leaked into the cylinder(s). At 314, subsequent idle stop conditions are assessed. If idle stop conditions are not met, the method 300 loops back to 312.

If the idle stop conditions are met, the method 300 proceeds to 315 to assess engine temperature and if it is below a threshold the method 300 proceeds to 317 where the engine is shut down without specified positioning of identified cylinder. For example, the identified cylinder may be held in a condition where its exhaust valve is fully closed in this low temperature conditions. In one example, at temperature below a threshold at which fuel no longer vaporizes, the engine is shut down without re-positioning the identified cylinder. In another example, if idle stop occurs during engine operation where the engine has not yet warmed above this threshold temperature, then the engine may be stopped without further adjustment to move the selected cylinder to have its exhaust valve open.

As explained above, the threshold temperature may be based on a temperature at which the fuel vaporizes. If the engine is below the threshold temperature, the fuel that leaks out of the injector may remain in liquid form on the walls of the cylinder, for example, and thus may not travel out of an open exhaust valve. Accordingly, the energy needed to rotate the engine (via the starter motor, for example) may be conserved by dispensing with the repositioning of the engine during these conditions. Further, the threshold temperature may be based on a volatility of the fuel. For example, the threshold temperature may be lower for fuel that includes a higher proportion of ethanol (e.g., E100) that fuel that includes a lower proportion of ethanol (e.g., gasoline). Method 300 then returns.

At 315, if engine temperature is above a threshold, the method proceeds to 316 to execute an engine shut down and position the engine in order to place cylinder with leaky fuel injector in a specific orientation such as an exhaust stroke position, wherein the exhaust valve is open, at least in part, aiding in release of leaked fuel vapors from the cylinder, as further elaborated in FIG. 4.

Continuing now to FIG. 4, an example routine 400 to mitigate the effects of fuel leak from an identified fuel injector in an engine cylinder is illustrated. Method 400 may be performed in response to an indication that fuel injector of a cylinder of an engine is leaking, and further in response to a request to shut down the engine. In one example, method 400 may be executed as part of method 300 described above. At 402, the engine is shut down in response to a request to perform an idle stop. As examples, fuel injection is suspended, spark is deactivated, etc., resulting in engine speed decreasing as the engine spins down to a rest. The method 400 proceeds to 404 as engine is in the process of shutting down or has shut down completely. At 404, the final engine position is determined. In one example, a sensor, such as the engine position sensor 118 in FIG. 2, may be used to monitor the crankshaft angle to determine the position of the piston and the corresponding stroke at which the identified cylinder is predicted to be positioned when the engine comes to a rest.

The method 400 then proceeds to 406 to assess if the engine is or will be in a selected position when the engine comes to a rest, where the selected position includes the identified cylinder being in the exhaust stroke position at rest or otherwise having its exhaust valve at least partly open. If no, the method 400 proceeds to 418, where the position of the engine is adjusted in order to position the identified cylinder with the leaky fuel injector with its exhaust valve open. In one example, adjusting the engine position may include rotating the engine with an electric motor, such as a starter motor, as indicated at 420. For example, the starter motor may be used to rotate the engine until the identified cylinder is in the exhaust stroke position. In another example, an auxiliary load may be used to alter engine rotation such that the engine stops with the identified cylinder in the exhaust stroke, as indicated at 422. In one example, rotating the engine with the electric motor to the selected engine position comprises determining a first amount of forward rotation to reach the selected engine position and determining a second amount of reverse rotation to reach the selected engine position. The rotation direction with the smallest amount of rotation needed to reach the selected position may be selected, such that if the first amount is greater than the second amount, the engine is rotated with the second amount of reverse rotation, and when the first amount is less than the second amount, the engine is rotated with the first amount of forward rotation. In one more example, adjusting the engine position may include rotating the crankshaft, which is mechanically coupled by a cam belt to the camshaft, such that it moves the camshaft and positions the cam surface to press the valve stem of the exhaust valve against its return spring to hold it in the open position in the identified cylinder once the engine rotation is stopped, as indicated at 424. The method 400 then proceeds to 408.

At 406, if the cylinder is already in its exhaust stroke, engine re-positioning is not performed and the method 400 proceeds to 408. At 408, the leaked fuel vapors from the cylinder with the leaky fuel injector, positioned in its exhaust stroke, escape through the open/partly open exhaust valve to an emission control device which may be a three way catalyst. At 410, a subsequent request for an engine start is assessed. In one example, upon release of the brake pedal by the vehicle operator, the controller, such as the controller 12 shown in FIG. 2, may indicate that an idle restart has been requested. If an engine start request is not received, the engine remains at idle stop while holding/converting the leaked fuel vapors in the catalyst. If an engine start is requested, the engine is started at 412. As an example, the starter motor may rotate the engine and fuel injection may commence along with unlocking of the transmission to increase torque to the driving wheels and resuming vehicle movement. The method 400 then proceeds to 414.

At 414, the oxygen storage capacity of the catalyst is determined. In one example, the change in oxygen storage capacity is determined based on a difference between a first oxygen storage capacity of the catalyst at the engine start-up and a second oxygen storage capacity of the catalyst at a prior engine start-up before the identification of the cylinder having the fuel injector leak. In one example, the oxygen storage capacity of the catalyst may be determined based on upstream and downstream exhaust oxygen concentration, as determined by oxygen sensors placed at the inlet and outlet of a catalytic converter (e.g., sensors 6 and 7 of FIG. 1), catalyst temperature, exhaust mass flow, and/or catalyst composition. Storage and/or conversion of the fuel vapors from the leaky injector may deplete the catalyst of oxygen. A high oxygen storage capacity and a low amount of oxygen stored in the catalyst at a time when an engine is started may result in less efficient oxidation of captured fuel vapors and other exhaust constituents in the catalytic converter. If the oxygen storage amount in the catalyst is below a predetermined value, at 416, oxygen storage may be increased during or following the engine start. For example, during the engine start-up event following the engine shutdown, the engine air-fuel ratio may be adjusted (e.g., the engine may be operated with a lean air-fuel ratio) based on the change in oxygen storage capacity of the catalyst. In this way, effects of fuel injector leak on the catalyst function can be mitigated during engine idle stops.

FIG. 5 shows simulated plots of fuel rail pressure and fuel pump operation during an engine idle stop event. Map 504 shows fuel rail pressure plotted on the Y axis, and map 506 shows fuel pump operation (on or off) on the Y axis. The X axis represents time, increasing from the left side of the figure to the right side of the figure. Vertical markers indicate the times of interest, for example, idle stop time from $T_1$–$T_2$. Fuel rail pressure curves are indicated by 500 and 508.

Between time $T_0$–$T_1$, fuel pump is on, pumping fuel to the fuel rail (map 506), such that no change in fuel rail pressure curve is observed (map 504). During the idle stop event from $T_1$–$T_2$, the fuel pump is off and not delivering fuel to the fuel rail. At the time interval $T_1$–$T_2$, map 504 shows that the fuel pressure curve 500 has a slightly downward trajectory, indicating a minor drop in pressure, as would be expected upon suspension of fuel pump operation during idle stop. Conversely, fuel rail pressure curve 508 shows a more significant downward trajectory (e.g., increased pressure decay rate relative to the no leak curve) during the time interval $T_1$–$T_2$, indicating the presence of fuel leak. In one example, a decrease in fuel rail pressure during idle stop event may indicate a leak in one or more fuel injectors. At the end of an idle stop, after time $T_2$, when the fuel pump is at on position and pumping fuel into the fuel rail, a corresponding increase in fuel rail pressure is observed, as shown in an example plot in map 504.

Referring now to FIG. 6, example plots showing the positions of intake and exhaust valves in the identified leaky cylinder, along with corresponding engine speed and starter motor operation over the course of two four-stroke engine cycles at an idle stop are illustrated. Map 602 shows the intake valve position curve 612 and map 604 shows the exhaust valve position curve 614 along their respective Y axes. Map 606 shows an example plot of starter motor activation 616, and map 608 shows engine speed curve 618, plotted along the Y axis. The X axis represents respective engine strokes for two consecutive engine cycles, first cycle 610 and second cycle 611. The first cycle 610 is the last cycle before the engine comes to a rest after fuel injection has stopped. The second cycle 611 is when the motor is activated to reposition the engine. The duration of each engine stroke is marked with vertical lines. In one example, $T_0$–$T_1$ is the interval showing intake stroke, followed by compression stroke from $T_1$–$T_2$ power stroke from $T_2$–$T_3$, and an exhaust stroke from $T_3$–$T_4$. In the consecutive cycle 611, the intake, compression, power, and exhaust stroke intervals are marked by $T_4$–$T_5$, $T_5$–$T_6$, $T_6$–$T_7$, and $T_7$–$T_8$, respectively. It should be noted that the duration of each stroke of the four-stroke cycle may vary, e.g., each stroke may last longer than previous strokes due to the slowing speed of the crankshaft. During first cycle 610, intake valve curve 612 of the identified cylinder shows an opening of intake valve during the intake phase $T_0$–$T_1$, while the exhaust valve curve 614 shows a closed valve position. At the exhaust stroke time interval $T_3$–$T_4$, the intake valve continues to be closed while the exhaust valve opens. The starter motor is not engaged during this interval, as shown in map 606.

During second cycle 611, a starter motor is engaged to rotate the engine to a selected position based on the identified cylinder such that the identified cylinder is positioned in its exhaust stroke $T_7$–$T_8$ with the exhaust valve open, and the intake valve closed. The starter motor is then deactivated and the engine remains in the selected position.

In one example, the re-positioning of the engine may be based on input from an electronic sensor assessing crankshaft position at shut down. For example, the selected engine position may be a range of crankshaft angles at which the exhaust valve of the identified cylinder is at least partly open, such as 540-720° CA, and the engine may be rotated with the starter motor until the crankshaft angle reaches an angle within the range of crankshaft angles. In another example, the selected engine position may be a crankshaft angle where the exhaust valve is positioned with a greatest amount of lift, such as 630° CA, and the engine may be rotated with the starter motor until the crankshaft angle of the engine is within a threshold range (e.g., 10° C.) of the selected position. Further, in some examples where the vehicle includes variable valve timing, the selected position may be based on the configuration of the variable valve timing system at the time of engine shutdown. For example, during some engine shutdowns, the exhaust valve of the identified cylinder may be open at 540-720° CA while during other engine shutdowns where the variable valve timing system has adjusted exhaust valve timing, the exhaust valve of the identified cylinder may be open at 500-720° CA or other suitable engine position. The starter motor may rotate the engine based on crankshaft position in a desired direction e.g., forward or backward, such that the least rotation is required for positioning the engine to the selected position.

The starter motor may be engaged while the engine is still spinning down and approaching rest in order to reduce the energy required to rotate the engine by the starter motor, or the starter motor may be engaged once the engine has already stopped. In another example, an auxiliary load may be used to alter engine rotation and position the engine at the selected position. For example, an air conditioning compressor may be engaged, thus adding load to the engine. The added load may cause the engine to spin to a stop faster than without the added load. In another example, no re-positioning of the engine may be required as the engine position at stop may already be in the selected position. In one example, the battery state of the vehicle may influence the engine re-positioning, wherein rotating the engine with the electric motor comprises only rotating the engine with the electric motor when a battery state of charge is above a threshold charge. In this way, during idle stop events, positioning a cylinder with a leaky fuel injector in its exhaust stroke, with the exhaust valve open, at least in part, can mitigate the effects of leaky fuel injector.

While the engine shutdown routine in response to a leaky fuel injector has been described above with respect to an engine idle stop shutdown, it is to be understood that the engine shutdown routine described above with respect to FIGS. 4 and 6 may be performed during other engine shutdowns. For example, the engine may be re-positioned such that the identified cylinder with the leaky fuel injector is stopped with its exhaust valve at least partly open at or after a standard, operator-requested engine shutdown. In another example, the engine may be re-positioned such that the identified cylinder with the leaky fuel injector is stopped with its exhaust valve at least partly open at or after engine shutdown in response to a switch from an engine mode to a battery mode in a hybrid vehicle.

The technical effect of re-positioning engine cylinder with leaky fuel injector, wherein its exhaust valve is open during idle stops, allows for the leaked fuel vapors to diffuse out through the exhaust valve to a catalytic converter, where the fuel vapors are oxidized to produce less harmful emissions. This method also reduces engine restart problems like misfire, stumble, and hydro lock after prolonged starting and stopping events and prevents leaked fuels from causing engine damage.

A method for an engine includes identifying a cylinder of an engine with a fuel injector leak; and at or after engine shutdown, positioning the engine to a selected engine position based on the identified cylinder such that an exhaust valve of the identified cylinder is at least partly open. In a first example of the method, positioning the engine to the selected engine position comprises positioning the engine during non-combusting, non-engine driving conditions. A second example of the method optionally includes the first example and further includes wherein positioning the engine to the selected position comprises rotating the engine with an electric motor to remain stopped at the selected engine position where the exhaust valve of the identified cylinder is at least partly open. A third example of the method optionally includes one or both of the first and second examples and further includes wherein rotating the engine with the electric motor to the selected engine position comprises rotating the engine with the electric motor responsive to the engine coming to a rest. A fourth example of the method optionally includes one or more or each of the first through third examples and further includes wherein rotating the engine with the electric motor to the selected engine position comprises determining a first amount of forward rotation to reach the selected engine position, determining a second amount of reverse rotation to reach the selected engine position, and rotating the engine with the electric motor with either the first amount of forward rotation or the second amount of reverse rotation. A fifth example of the method optionally includes one or more or each of the first through fourth examples and further includes wherein when the first amount is greater than the second amount, the engine is rotated with the second amount of reverse rotation, and when the first amount is less than the second amount, the engine is rotated with the first amount of forward rotation. A sixth example of the method optionally includes one or more or each of the first through fifth examples, and further comprises only rotating the engine with the electric motor when a battery state of charge is above a threshold charge. A seventh example of the method optionally includes one or more or each of the first through sixth examples, and includes, initiating an idle engine stop responsive to one or more of engine speed, brake pedal position, and accelerator pedal position, and wherein positioning the engine to the selected engine position comprises positioning the engine at or after the idle engine stop is initiated.

Another embodiment of a method for an engine having a plurality of cylinders comprises identifying a cylinder of the plurality of cylinders of the engine having a fuel injector leak; during engine operation, adjusting an amount of fuel supplied to one or more cylinders of the plurality of cylinders of the engine; and at or after engine shutdown, positioning the engine to a selected engine position based on the identified cylinder such that an exhaust valve of the identified cylinder is at least partly open. In a first example of the method, adjusting an amount of fuel supplied to one or more remaining cylinders of the plurality of cylinders of the engine comprises determining an amount of fuel leaked into the identified cylinder during an engine cycle; and reducing an amount of fuel supplied to the one or more remaining cylinders during a subsequent engine cycle by an amount corresponding to the amount of fuel leaked into the identified cylinder. A second example of the method optionally includes the first example and further includes wherein determining the amount of fuel leaked into the identified cylinder during the engine cycle comprises determining the amount of fuel leaked into the identified cylinder during the engine cycle based on output from an exhaust oxygen sensor. A third example of the method optionally includes one or both of the first and second examples and further includes wherein determining the amount of fuel leaked into the identified cylinder during the engine cycle comprises determining the amount of fuel leaked into the identified cylinder during the engine cycle based on a change in oxygen storage capacity of a catalyst positioned downstream of the engine during the engine shutdown. A fourth example of the method optionally includes one or more or each of the first through third examples and further includes wherein the change in oxygen storage capacity is determined based on a difference between a first oxygen storage capacity of the catalyst at a subsequent engine start-up and a second oxygen storage capacity of the catalyst at a prior engine start-up before the identification of the cylinder having the fuel injector leak. A fifth example of the method optionally includes one or more or each of the first through fourth examples and further includes during an engine start-up event following the engine shutdown, adjusting an engine air-fuel ratio based on the change in oxygen storage capacity of the catalyst. A sixth example of the method optionally includes one or more or each of the first through fifth examples and further includes wherein the engine shutdown is an idle engine shutdown performed automatically based on operator requested torque. A seventh example of the method optionally includes one or more or each of the first through sixth examples and further includes wherein positioning the engine to the selected engine position comprises adjusting a load placed on the engine during the engine shutdown. An eighth example of the method optionally includes one or more or each of the first through seventh examples and further includes wherein adjusting the amount of fuel supplied to one or more cylinders of the plurality of cylinders of the engine comprises adjusting the amount of fuel supplied to the identified cylinder.

A further embodiment of a method for an engine having a plurality of cylinders, comprises when a fuel system leak test indicates a fuel injector leak, identifying a cylinder of the plurality of cylinders having the fuel injector leak, and at or after engine shutdown, rotating the engine with an electric motor to a selected engine position based on the identified cylinder; and when the fuel system leak test indicates no fuel injector leaks, at or after engine shutdown, maintaining the engine at a final resting position. In a first example of the method, the selected engine position is an engine position where the identified cylinder is in an exhaust stroke. A second example of the method optionally includes the first example and further includes wherein the selected engine position is an engine position where an exhaust valve of the identified cylinder is within a threshold range of a position of maximum valve lift for the exhaust valve. A third example of the method optionally includes one or both of the first and second examples and further includes wherein when the fuel system leak test indicates no fuel injector leaks, at or after engine shutdown, maintaining the engine at the final resting position comprises maintaining the engine at an undefined final resting position without rotating the engine with the electric motor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

identifying a cylinder of an engine with a fuel injector leak; and at or after engine shutdown, positioning the engine to a selected engine position based on the identified cylinder such that an exhaust valve of the identified cylinder is at least partly open.

2. The method of claim 1, wherein positioning the engine to the selected engine position comprises positioning the engine during non-combusting, non-engine driving conditions.

3. The method of claim 1, wherein positioning the engine to the selected position comprises rotating the engine with an electric motor to remain stopped at the selected engine position where the exhaust valve of the identified cylinder is at least partly open.

4. The method of claim 3, wherein rotating the engine with the electric motor to the selected engine position comprises rotating the engine with the electric motor responsive to the engine coming to a rest.

5. The method of claim 3, wherein rotating the engine with the electric motor to the selected engine position comprises determining a first amount of forward rotation to reach the selected engine position, determining a second amount of reverse rotation to reach the selected engine position, and rotating the engine with the electric motor with either the first amount of forward rotation or the second amount of reverse rotation.

6. The method of claim 5, wherein when the first amount is greater than the second amount, the engine is rotated with the second amount of reverse rotation, and when the first amount is less than the second amount, the engine is rotated with the first amount of forward rotation.

7. The method of claim 3, wherein rotating the engine with the electric motor comprises only rotating the engine with the electric motor when a battery state of charge is above a threshold charge.

8. The method of claim 1, further comprising initiating an idle engine stop responsive to one or more of engine speed, brake pedal position, and accelerator pedal position, and wherein positioning the engine to the selected engine position comprises positioning the engine at or after the idle engine stop is initiated.

9. A method for an engine having a plurality of cylinders, comprising:

identifying a cylinder of the plurality of cylinders of the engine having a fuel injector leak;

during engine operation, adjusting an amount of fuel supplied to one or more cylinders of the plurality of cylinders of the engine; and at or after engine shutdown, positioning the engine to a selected engine position based on the identified cylinder such that an exhaust valve of the identified cylinder is at least partly open.

10. The method of claim 9, wherein adjusting an amount of fuel supplied to one or more remaining cylinders of the plurality of cylinders of the engine comprises:

determining an amount of fuel leaked into the identified cylinder during an engine cycle; and reducing an amount of fuel supplied to the one or more remaining cylinders during a subsequent engine cycle by an amount corresponding to the amount of fuel leaked into the identified cylinder.

11. The method of claim 10, wherein determining the amount of fuel leaked into the identified cylinder during the engine cycle comprises determining the amount of fuel leaked into the identified cylinder during the engine cycle based on output from an exhaust oxygen sensor.

12. The method of claim 10, wherein determining the amount of fuel leaked into the identified cylinder during the engine cycle comprises determining the amount of fuel leaked into the identified cylinder during the engine cycle based on a change in oxygen storage capacity of a catalyst positioned downstream of the engine during the engine shutdown, and wherein the change in oxygen storage capacity is determined based on a difference between a first oxygen storage capacity of the catalyst at a subsequent engine start-up and a second oxygen storage capacity of the catalyst at a prior engine start-up before the identification of the cylinder having the fuel injector leak.

13. The method of claim 12, further comprising, during an engine start-up event following the engine shutdown, adjusting an engine air-fuel ratio based on the change in oxygen storage capacity of the catalyst.

14. The method of claim 9, wherein adjusting the amount of fuel supplied to one or more cylinders of the plurality of cylinders of the engine comprises adjusting the amount of fuel supplied to the identified cylinder.

15. The method of claim 9, wherein the engine shutdown is an idle engine shutdown performed automatically based on operator requested torque.

16. The method of claim 9, wherein positioning the engine to the selected engine position comprises adjusting a load placed on the engine during the engine shutdown.

17. A method for an engine having a plurality of cylinders, comprising:

when a fuel system leak test indicates a fuel injector leak, identifying a cylinder of the plurality of cylinders having the fuel injector leak, and at or after engine shutdown, rotating the engine with an electric motor to a selected engine position based on the identified cylinder; and when the fuel system leak test indicates no fuel injector leaks, at or after engine shutdown, maintaining the engine at a final resting position.

18. The method of claim 17, wherein the selected engine position is an engine position where the identified cylinder is in an exhaust stroke.

19. The method of claim 17, wherein the selected engine position is an engine position where an exhaust valve of the identified cylinder is within a threshold range of a position of maximum valve lift for the exhaust valve.

20. The method of claim 17, wherein when the fuel system leak test indicates no fuel injector leaks, at or after engine shutdown, maintaining the engine at the final resting position comprises maintaining the engine at an undefined final resting position without rotating the engine with the electric motor.

* * * * *